US011097443B2

(12) United States Patent
Wang

(10) Patent No.: US 11,097,443 B2
(45) Date of Patent: Aug. 24, 2021

(54) PUSHER FOR PLANER

(71) Applicant: Long-Wei Wang, Taichung (TW)

(72) Inventor: Long-Wei Wang, Taichung (TW)

( * ) Notice: Subject to any disclaimer, the term of this patent is extended or adjusted under 35 U.S.C. 154(b) by 182 days.

(21) Appl. No.: 16/430,449

(22) Filed: Jun. 4, 2019

(65) Prior Publication Data

US 2020/0384665 A1 Dec. 10, 2020

(51) Int. Cl.

| | |
|---|---|
| ***B27C 1/14*** | (2006.01) |
| ***B27C 1/12*** | (2006.01) |
| ***B27C 1/02*** | (2006.01) |

(52) U.S. Cl.

CPC ..... *B27C 1/14* (2013.01); *B27C 1/02* (2013.01); *B27C 1/12* (2013.01)

(58) Field of Classification Search

CPC .... B27C 1/12; B27C 1/00; B27C 1/02; B27C 1/14

See application file for complete search history.

(56) References Cited

U.S. PATENT DOCUMENTS 1,736,641 A * 11/1929 Zimmerman ..... B27C 1/12 144/117.1
3,291,170 A * 12/1966 Nishimura ..... B27C 1/12 144/117.1
2010/0000630 A1* 1/2010 Chuang ..... B27C 1/12 144/128

FOREIGN PATENT DOCUMENTS

EP 0321390 A2 * 6/1989 ..... B27C 5/06

* cited by examiner

*Primary Examiner* — Christopher R Harmon

(57) ABSTRACT

A pusher for a planer contains: a body, a planer, a movable control portion, and a push member. The planer includes a cutter, a drive shaft, a transmission portion, a horizontal rod, a reduction wheel, and a threaded portion. An upper belt is fitted on the lower belt, a wheel rod and an auxiliary rod. The wheel rod includes a second receiving portion, a guiding portion, and a pushing wheel. The guiding portion has a transmitting belt fitted on an actuation rod. The actuation rod has a driving portion and another pushing wheel. The auxiliary rod is supported on an auxiliary abutting block inserted onto a positioning rod, and a returning spring is fitted on the positioning rod. The movable control portion includes a rotary shaft and a movable pedestal. The press post has two pressing wheels, and a control wheel is biased against the transmitting belt.

3 Claims, 7 Drawing Sheets

PUSHER FOR PLANER

FIELD OF THE INVENTION

The present invention relates to a pusher for a planer which when the planer cutter rotates, the drive shaft transmits kinetic energy to the movable control portion to urge the pushing wheel to rotate synchronously, and the drive shaft drives the pushing wheel to rotate slowly via the reduction wheel, hence the wood is pushed slowly and is pressed and pushed by the pushing wheel to be planed automatically.

BACKGROUND OF THE INVENTION

A conventional planer contains a body on which a press device is arranged, and the conventional planer contains multiple idlers arranged in the press device so that when a wood is pushed through a body, it is pushed by a press force. Furthermore, the wood is pushed forward smoothly.

However, the conventional reading stand has defects as follows:

A wood is pushed by a user, but it cannot be pushed forward to be planed with an even pushing force.

The present invention has arisen to mitigate and/or obviate the afore-described disadvantages.

SUMMARY OF THE INVENTION

The primary aspect of the present invention is to provide a pusher for a planer which when the planer cutter rotates, the drive shaft transmits kinetic energy to the movable control portion to urge the pushing wheel to rotate synchronously, and the drive shaft drives the pushing wheel to rotate slowly via the reduction wheel, hence the wood is pushed slowly and is pressed and pushed by the pushing wheel to be planed automatically.

DETAILED DESCRIPTION OF THE PREFERRED EMBODIMENTS

Figure 1:
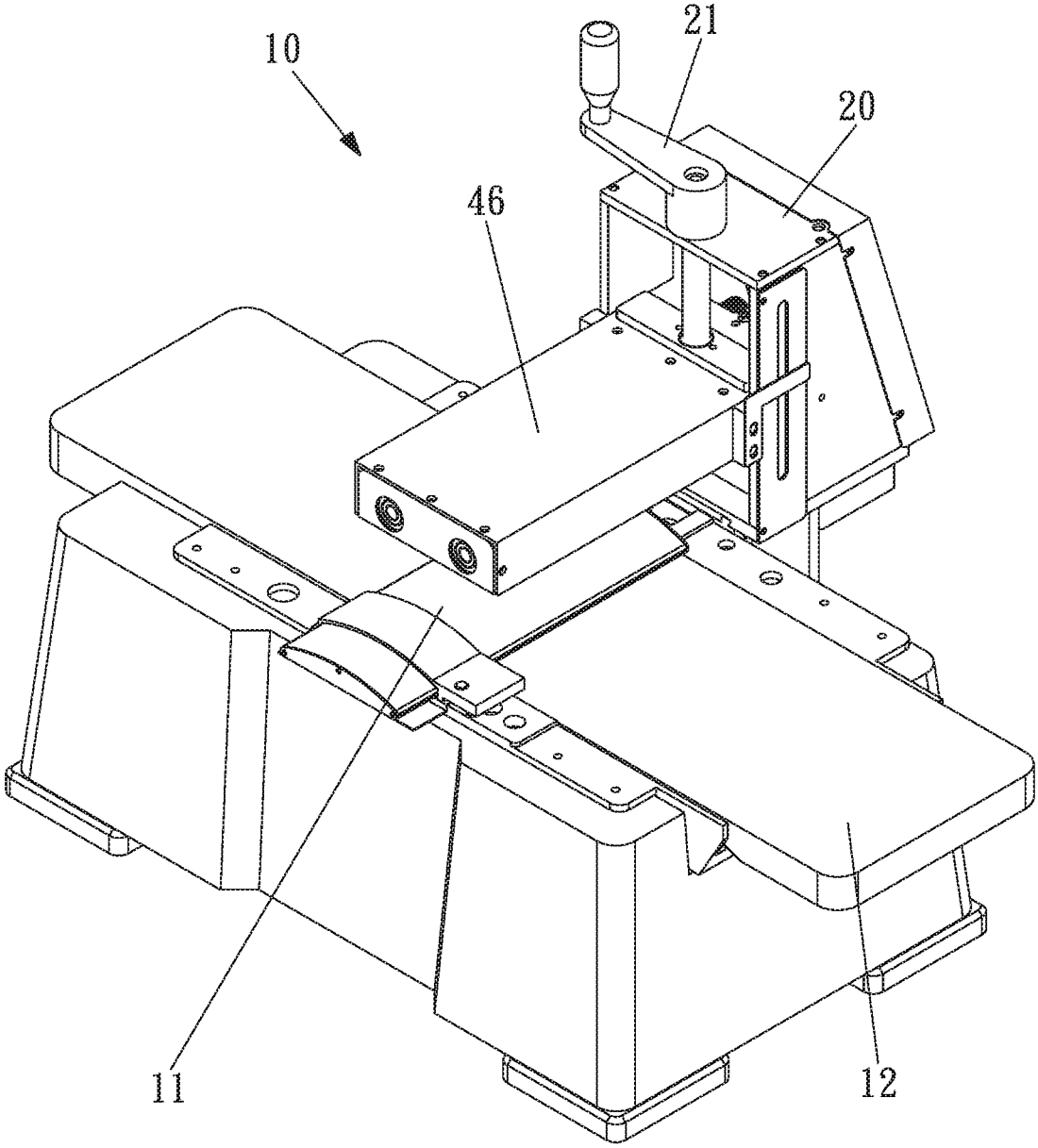
FIG. 1 is a perspective view showing the assembly of a pusher for a planer according to a preferred embodiment of the present invention.
Figure 2:
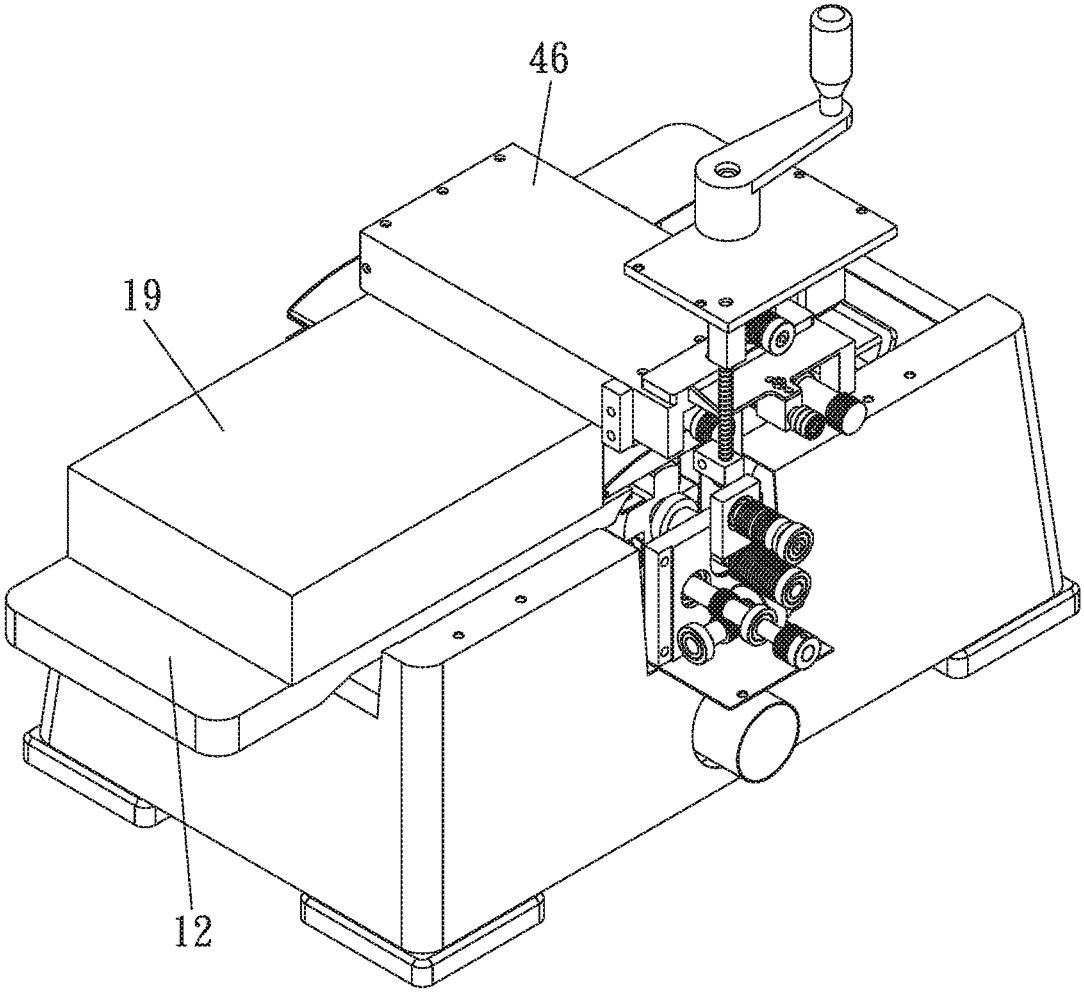
FIG. 2 is a perspective view showing the assembly of the pusher for the planer according to the preferred embodiment of the present invention.
Figure 3:
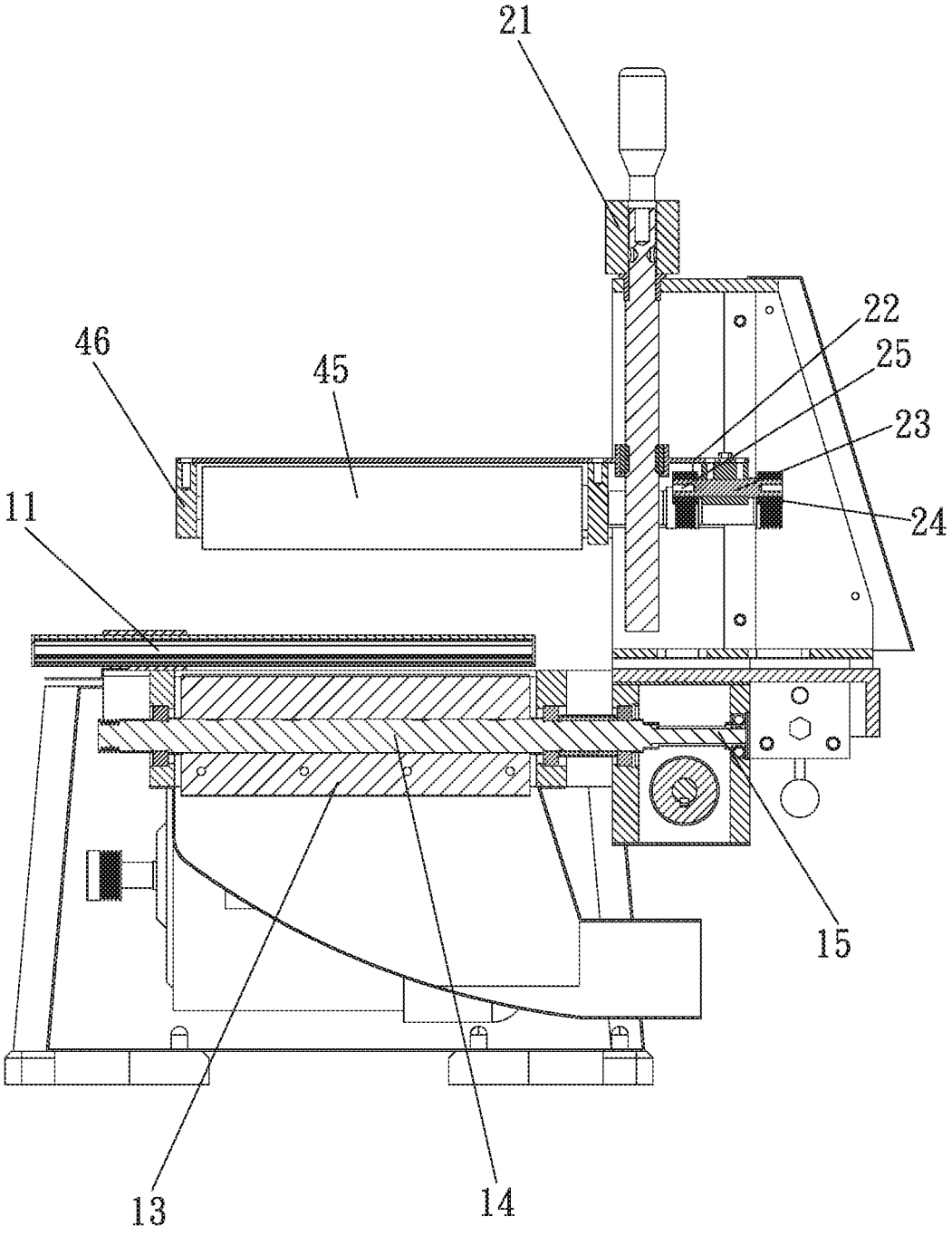
FIG. 3 is a cross sectional view showing the assembly of the pusher for the planer according to the preferred embodiment of the present invention.
Figure 4:
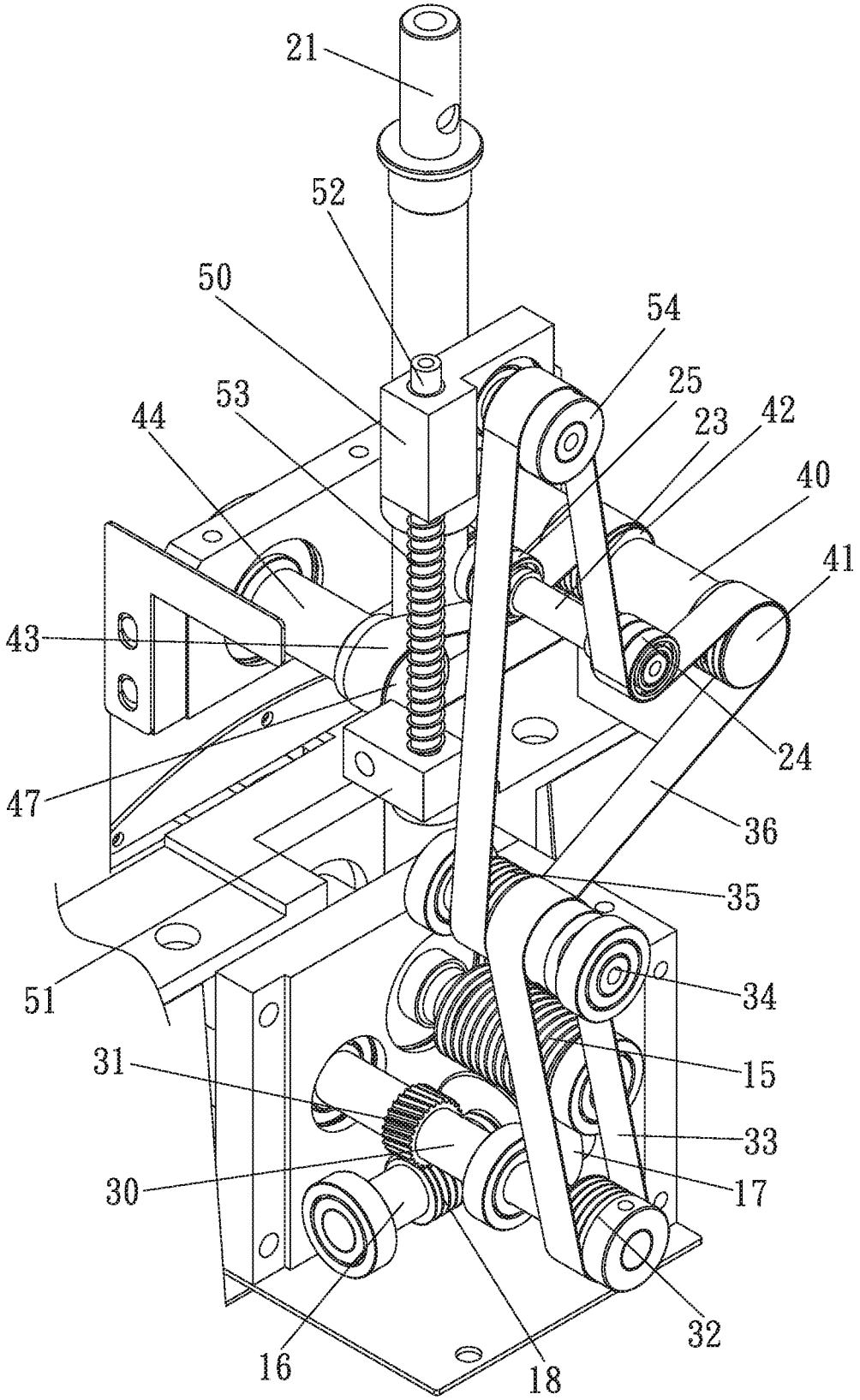
FIG. 4 is a perspective view showing the assembly of a part of the pusher for the planer according to the preferred embodiment of the present invention.

With reference to FIGS. 1-4, a pusher for a planer according to a preferred embodiment of the present invention comprises: a body 10, a planer 11 mounted on a top of the body 10, a movable control portion 20, a push member 46 arranged on a front end of the movable control portion 20 above the planer 11; wherein the planer 11 includes a cutter 13 and a drive shaft 14 in the body 10, the drive shaft 14 extends to a lower portion of the movable control portion 20, and a transmission portion 15 formed on a rear end of the body 10, a horizontal rod 16, a reduction wheel 17 connected with the horizontal rod 16, and a threaded portion 18 formed on the horizontal rod 16 and located beside the reduction wheel 17. The threaded portion 18 is screwed with a toothed protrusion 31 of a longitudinal rod 30, wherein a drive head 32 is formed on a rear end of the longitudinal rod 30. The drive head 32 of the longitudinal rod 30 is fitted with a first end of a lower belt 33, a second end of the lower belt 33 is fitted on a first receiving portion 35 of a transmission rod 34 above the longitudinal rod 30, an upper belt 36 is fitted on a front end of the lower belt 33, and the upper belt 36 is fitted on a wheel rod 40 and an auxiliary rod 54. The wheel rod 40 includes a second receiving portion 41 of a rear end thereof, a guiding portion 42 formed on a front end of the second receiving portion 41, a pushing wheel 45 fixed in the push member 46 of the wheel rod 40. The upper belt 36 is fitted on the second receiving portion 41, and the guiding portion 42 has a transmitting belt 43 fitted on a first end thereof. A second end of the transmitting belt 43 is fitted on an actuation rod 44 beside the wheel rod 40, the actuation rod 44 has a driving portion 47 formed on a rear end thereof so as to fit with the transmitting belt 43, and the actuation rod 44 has another pushing wheel 45 connected with the push member 46.

The auxiliary rod 54 is supported on an auxiliary abutting block 50 inserted onto a positioning rod 52 which is mounted on a base 51, and a returning spring 53 is fitted on the positioning rod 52 between the base 51 and the auxiliary abutting block 50.

Furthermore, the movable control portion 20 includes a rotary shaft 21 mounted on an upper end of the movable control portion 20 and extending to the movable control portion 20 inwardly. The movable control portion 20 includes a movable pedestal 22 connected with the wheel rod 40 and the actuation rod 44, the movable pedestal 22 has a press post 24 arranged therebelow, the press post 24 has two pressing wheels 24 arranged on a front end and a rear end of the press post 24 respectively, a rear end of the press post 24 abuts against the upper belt 36 between the auxiliary rod 54 and the second receiving portion 41, and a control wheel 25 is biased against the transmitting belt 43 between the guiding portion 42 and the actuation portion 47.

Figure 5:
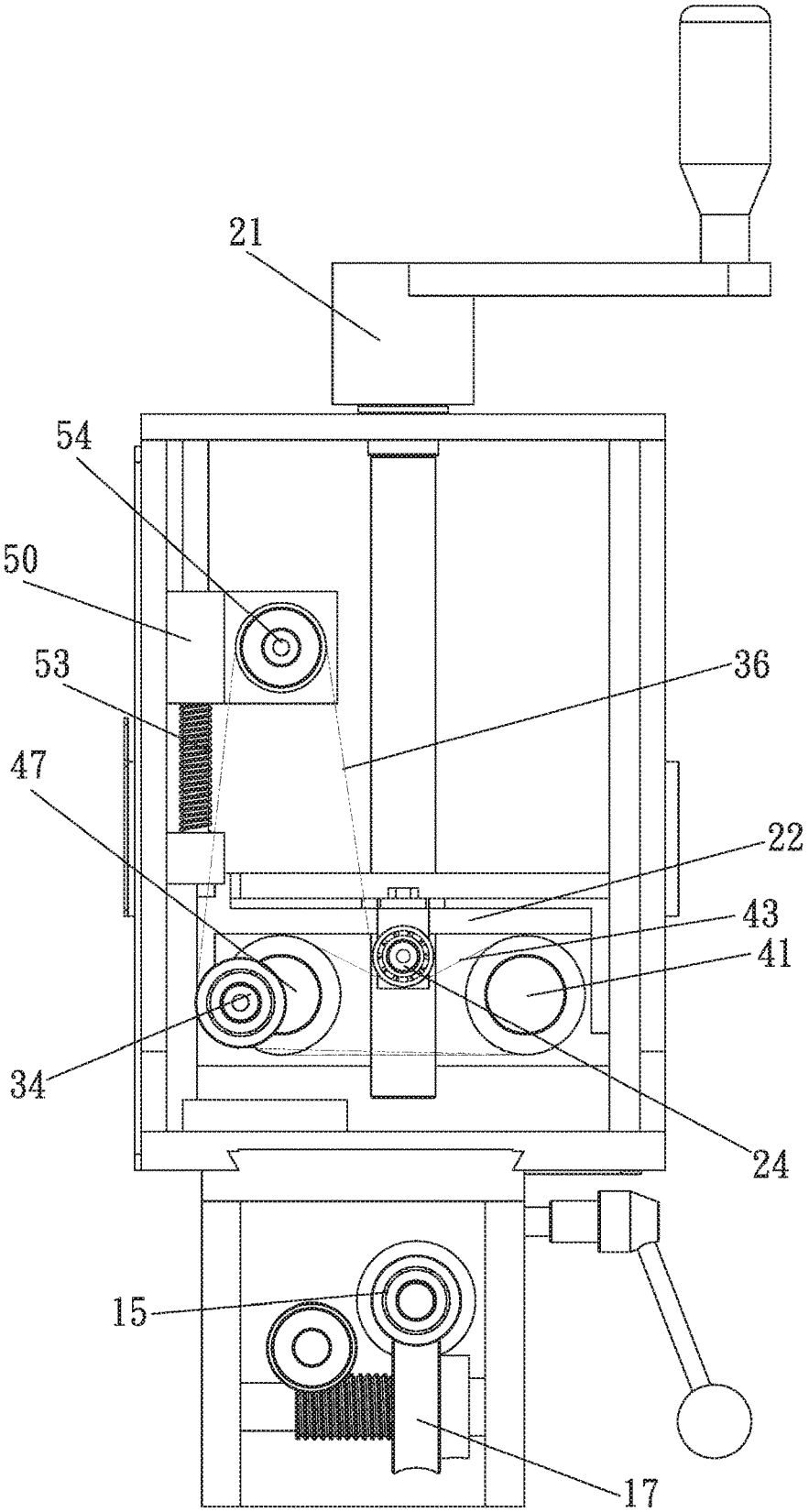
FIG. 5 is a side plan view showing the operation of a part of the pusher for the planer according to the preferred embodiment of the present invention.
Figure 6:
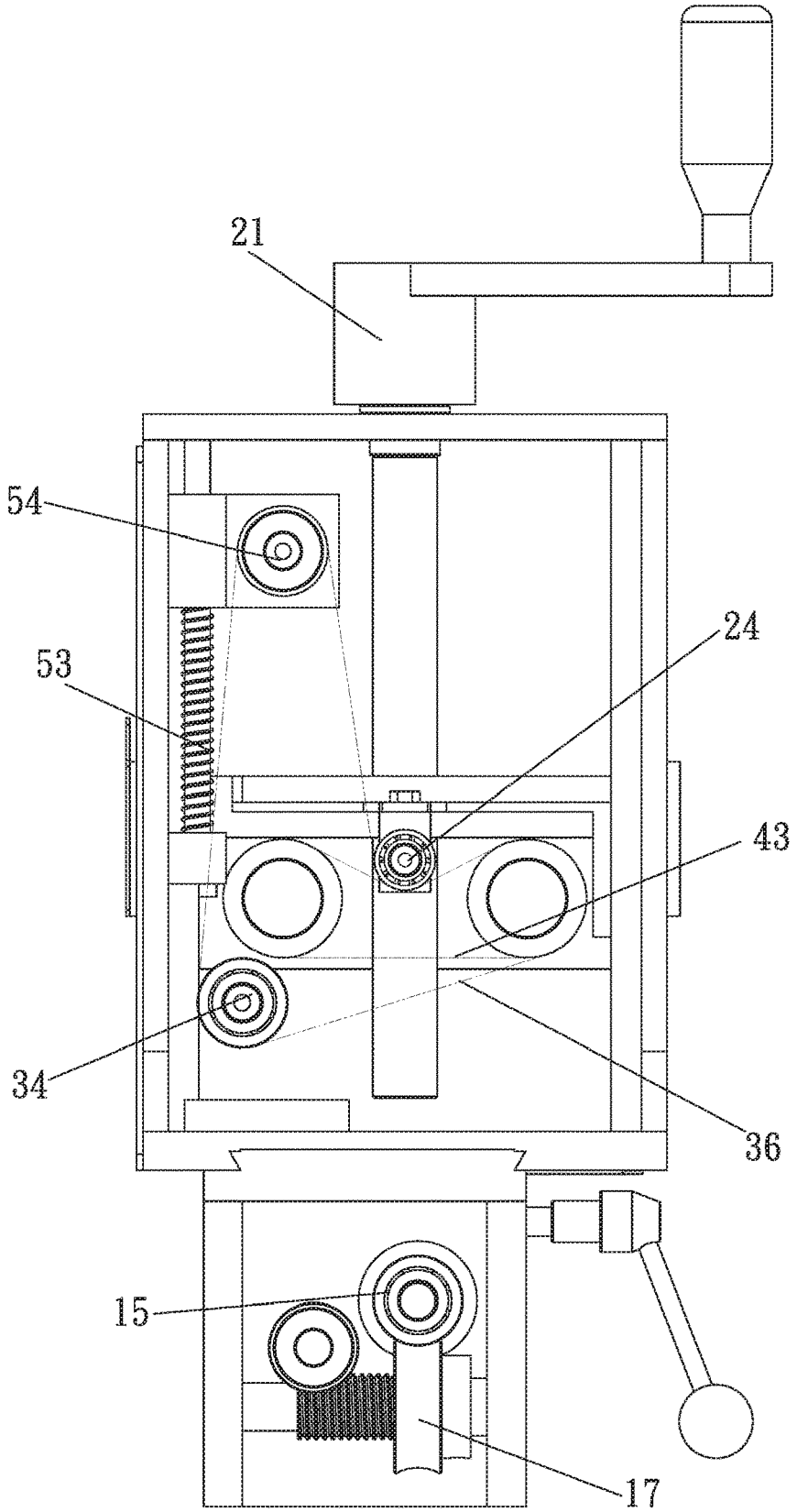
FIG. 6 is another side plan view showing the operation of a part of the pusher for the planer according to the preferred embodiment of the present invention.
Figure 7:
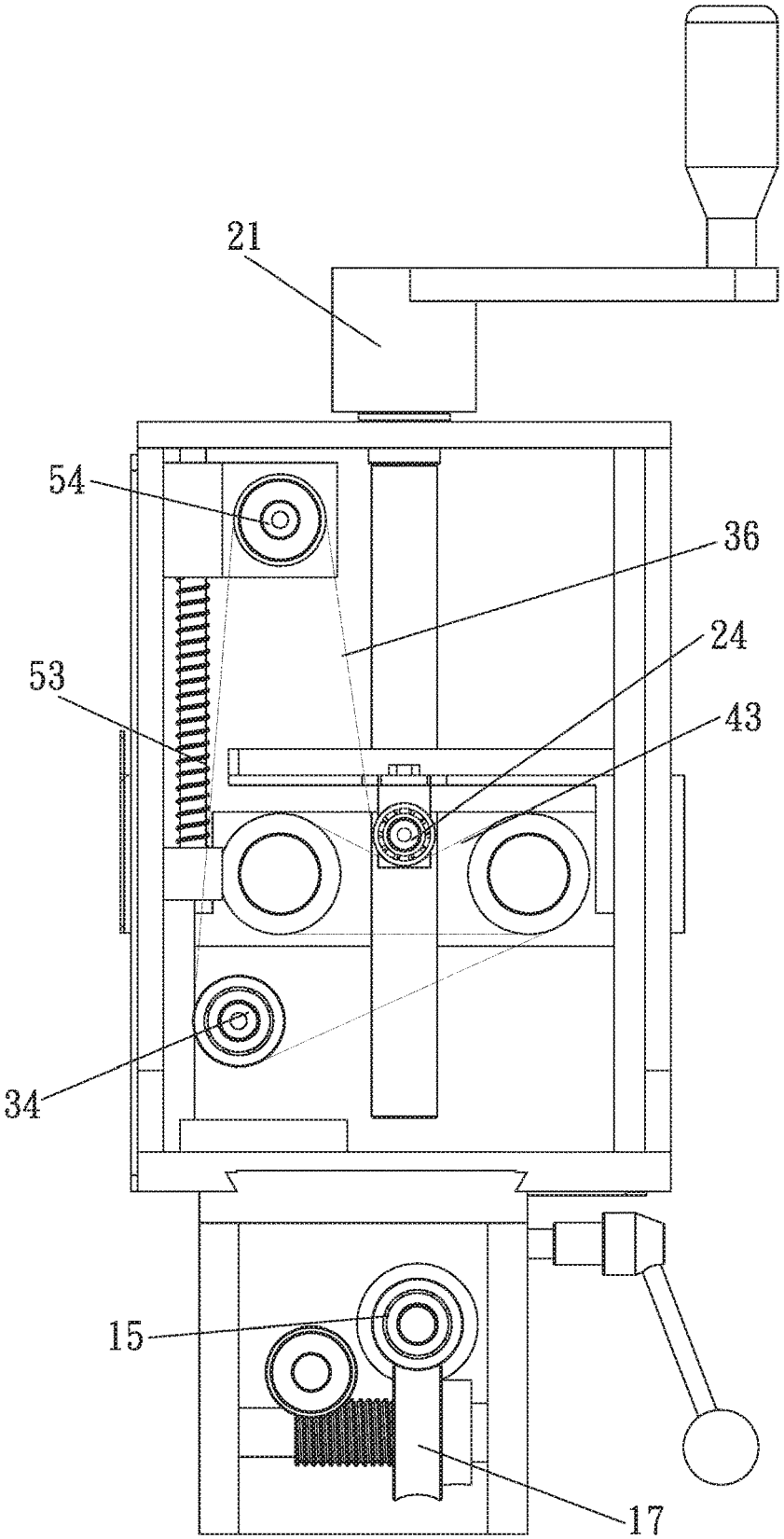
FIG. 7 is another side plan view showing the operation of a part of the pusher for the planer according to the preferred embodiment of the present invention.

Referring to FIGS. 4-7, after controlling the rotary shaft 21 of the movable control portion 20, the movable pedestal 22 of the movable control portion 20 lifts and descends. In the meantime, the press post 24 and the control wheel 25 of the press post 23 abut against the upper belt 36 and the transmitting belt 43 respectively, and the auxiliary abutting block 50 is pushed upward by the returning spring 53, such that when the push member 46 is pushed to any heights, the upper belt 36 and the transmitting belt 43 are tight.

Accordingly, when the planer operates, a wood is pushed to the planer 11 from a platform 12, the wood 19 contacts with the pushing wheel 45 of the push member 46, and a user rotates the rotary shaft 21 to control the pushing wheel 45 to press the wood 19. When the planer cutter 13 rotates, the drive shaft 14 transmits kinetic energy to the movable control portion 20 to urge the pushing wheel 45 to rotate synchronously, and the drive shaft 14 drives the pushing wheel 45 to rotate slowly via the reduction wheel 17, thus pushing the wood 19 slowly. The wood 19 is pressed and pushed by the pushing wheel 45 to be planed automatically.

While the preferred embodiments of the invention have been set forth for the purpose of disclosure, modifications of the disclosed embodiments of the invention and other embodiments thereof may occur to those skilled in the art. Accordingly, the appended claims are intended to cover all embodiments which do not depart from the spirit and scope of the invention.

What is claimed is:

1. A pusher for a planer comprising:

a body, a planer mounted on a top of the body, a movable control portion fixed on a rear end of the planer, and a push member arranged on a front end of the movable control portion above the planer;

wherein the planer includes a cutter and a drive shaft in the body, the drive shaft extends to a lower portion of the movable control portion, and a transmission portion formed on a rear end of the body, a horizontal rod, a reduction wheel connected with the horizontal rod, and a threaded portion formed on the horizontal rod and located beside the reduction wheel;

wherein the drive head of the longitudinal rod is fitted with a first end of a lower belt, a second end of the lower belt is fitted on a first receiving portion of a transmission rod above the longitudinal rod, the first receiving portion has an upper belt fitted thereon adjacent to the lower belt, and the upper belt is further fitted on a wheel rod and an auxiliary rod;

wherein the wheel rod includes a second receiving portion of a rear end thereof, a guiding portion formed on a front end of the second receiving portion, a pushing wheel fixed in the push member, the upper belt is fitted on the second receiving portion, and the guiding portion has a transmitting belt fitted on a first end thereof, a second end of the transmitting belt is fitted on an actuation rod beside the wheel rod, the actuation rod has a driving portion formed on a rear end thereof so as to fit with the transmitting belt, and the actuation rod has another pushing wheel connected with the push member;

wherein the auxiliary rod is supported on an auxiliary abutting block inserted onto a positioning rod which is mounted on a base, and a returning spring is fitted on the positioning rod between the base and the auxiliary abutting block; and wherein the movable control portion includes a rotary shaft mounted on an upper end of the movable control portion and extending to the movable control portion inwardly, the movable control portion includes a movable pedestal connected with the wheel rod and the actuation rod, the movable pedestal has a press post arranged therebelow, the press post has two pressing wheels arranged on a front end and a rear end of the press post respectively, a rear end of the press post abuts against the upper belt between the auxiliary rod and the second receiving portion, and a control wheel is biased against the transmitting belt between the guiding portion and the driving portion.

2. The pusher for the planer as claimed in claim 1, wherein after controlling the rotary shaft of the movable control portion, the movable pedestal of the movable control portion lifts and descends.

3. The pusher for the planer as claimed in claim 1, wherein when the movable pedestal of the movable control portion lifts and descends, the press post and the control wheel of the press post abut against the upper belt and the transmitting belt respectively, and the auxiliary abutting block is pushed upward by the returning spring, such that when the push member is pushed to any heights, the upper belt and the transmitting belt are tight.

* * * * *